US006626110B1

(12) United States Patent
Keller

(10) Patent No.: US 6,626,110 B1
(45) Date of Patent: Sep. 30, 2003

(54) APPARATUS FOR PRINTING ON SHEET MATERIAL

(75) Inventor: Guido Keller, Adlikon (CH)

(73) Assignee: Gretag Imaging Trading AG, Wettingen (CH)

( * ) Notice: Subject to any disclaimer, the term of this patent is extended or adjusted under 35 U.S.C. 154(b) by 161 days.

(21) Appl. No.: 09/809,314

(22) Filed: Mar. 16, 2001

(30) Foreign Application Priority Data

Mar. 17, 2000 (EP) ..... 00105345

(51) Int. Cl.[7] ..... B41F 21/14; B41J 11/28; B41J 2/01; G03G 15/00

(52) U.S. Cl. ..... 101/485; 101/479; 101/480; 400/621; 400/692; 347/104; 399/107; 399/110

(58) Field of Search ..... 101/485, 479, 101/480; 400/692, 621; 399/110, 107; 347/104

(56) References Cited

U.S. PATENT DOCUMENTS

| | | | | |
|---|---|---|---|---|
| 5,208,640 A | | 5/1993 | Horie et al. | |
| 5,253,028 A | * | 10/1993 | Gonda et al. | 355/309 |
| 5,331,890 A | * | 7/1994 | Miyoshi et al. | 101/177 |
| 5,859,711 A | * | 1/1999 | Barry et al. | 358/296 |
| 6,238,115 B1 | * | 5/2001 | Siverbrook et al. | 400/693 |

FOREIGN PATENT DOCUMENTS

| | | |
|---|---|---|
| DE | 197 14 951 A1 | 11/1998 |
| JP | 06 340137 | 12/1994 |

* cited by examiner

*Primary Examiner*—Andrew H. Hirshfeld
*Assistant Examiner*—Marvin P. Crenshaw
(74) *Attorney, Agent, or Firm*—Burns, Doane, Swecker & Mathis, LLP

(57) ABSTRACT

An apparatus for printing on sheet material is set-up in a modular fashion having physically added modules, particularly having modules stackable one on top of another, each module including a printing mechanism. The apparatus also includes a modular distributor unit that is distributed amongst the modules for distributing the blank sheet material to the available modules and, if required, for bringing together printed sheet material and for sorting the printed sheet material. The modules are designed such that they can be easily stacked one on top of another, so that no cabling or wiring has to be carried out. The connection of the individual modules with each other is made through a bus system having corresponding connection and expansion interfaces, for example in the form of plug-in connections. A central control unit is provided in a base module, which central control unit recognizes the connected expansion modules through the bus system and configures itself. The central control unit independently distributes the queued printing jobs to available modules and hence achieves optimally short run times for each individual job. The capacity parameters of the printing apparatus can be co-ordinated exactly with the needs of the user by means of the module concept.

12 Claims, 7 Drawing Sheets

Fig. 10
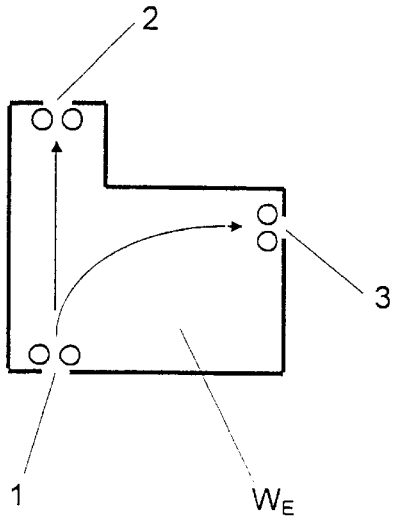
Fig. 12
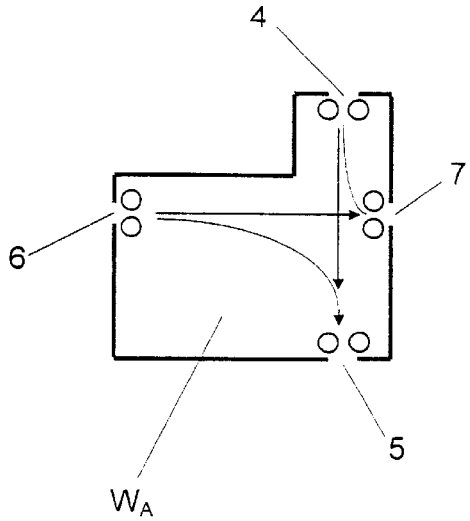
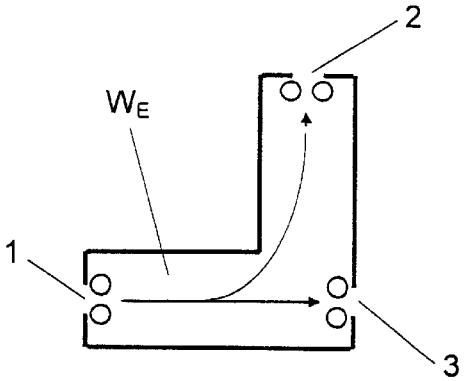
Fig. 11
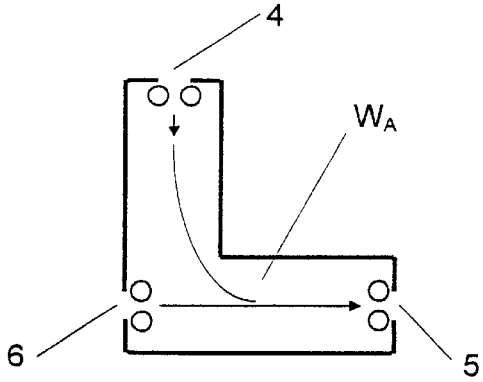
Fig. 13

APPARATUS FOR PRINTING ON SHEET MATERIAL

FIELD OF THE INVENTION

The invention relates to an apparatus for printing e.g. fotographic images on sheet material.

BACKGROUND OF THE INVENTION

Colour printing methods are particularly used aside from other image recording methods in the digital image production. However, the colour printers used therefor nowadays and based on inkjet technologies or colouring agent sublimation technologies are relatively slow, and reach a maximum print capacity of typically ca. 50 pictures per hour (based on a picture format of 10 cm×15 cm, for example). Although integrated systems, such as the Canon Hyperphoto System, have a higher capacity, they print on roll material and therefore offer only little formatting flexibility without subsequent cropping of the pictures. Individual sheets are inserted as a stack in common desktop printers, which requires an exchange of the stack of sheets upon a change in format. In order to reach a certain minimum capacity with currently available printers suited for the processing of sheet material, it is necessary to operate several printers of the same type in parallel. This on one hand causes considerable installation cost and on the other hand requires a relatively large mounting area.

SUMMARY OF THE INVENTION

It is now an object of the present invention to solve this problem and to correspondingly improve a printing apparatus in accordance with the prior art so that the printing apparatus has an increased printing capacity (productivity) on the one hand as opposed to common printing apparatuses and on the other hand can be adapted to changing demands in an easy and economical manner with respect to its productivity. Furthermore, the printing apparatus should require a mounting area which is substantially independent from its printing capacity.

According to the principle idea of the invention, the printing apparatus is built in a modular manner and consists of a more or less large number of modules stacked one on top of the other, each of the modules containing a complete printing mechanism with all required components, as well as a distribution system for distributing the queued printing jobs to the individual modules and if necessary to bring them together again or to sort them after printing.

With this module concept, the capacity parameters of the printing apparatus can be coordinated exactly with the needs of the user. It is also possible to subsequently increase the capacity of the apparatus through a later addition of further modules or to adapt the capacity to decreased demands through the removal of modules. A further advantage of the modular set-up of the printing apparatus in accordance with the invention is a high flexibility. For example, if one module fails, the total capacity of the apparatus is only reduced by the portion of the failed module but the function of the apparatus is retained as long as at least one module is functioning.

In accordance with a further important aspect of the invention, the modules are designed so that they can be easily joined together, i.e. they can be stacked one on top of the other, without having to carry out cabling or wiring. The connection of the individual modules with each other is carried out in accordance with a preferred embodiment through a bus system having corresponding connection and expansion interfaces, for example in form of plug-in connections. In a base module there is provided a central control unit which recognises the connected expansion modules through the bus system and configures itself. The central control unit divides the queued printing jobs independently between the available modules and hence achieves optimally short run times for each individual job.

If the modules are equipped with inkjet printing mechanisms, the ink reservoirs are only situated in the base module in accordance with a further important aspect of the invention, and they are common to all modules. The modules are provided with an additional hydraulic bus system, which connects each module with the ink reservoir on one hand and on the other hand facilitates a simple connection of the modules with each other by means of suitable hydraulic connection and expansion interfaces provided in each module, e.g. in form of plug-in pipe couplings.

BRIEF DESCRIPTION OF THE DRAWINGS

The invention will be further described in the following by way of the drawings.

FIGS. 10–13 show four sketches for clarification of the different transport paths realised through the input and output switching units of the modules of the apparatus.

DETAILED DESCRIPTION OF THE PREFERRED EMBODIMENT

Figure 1:
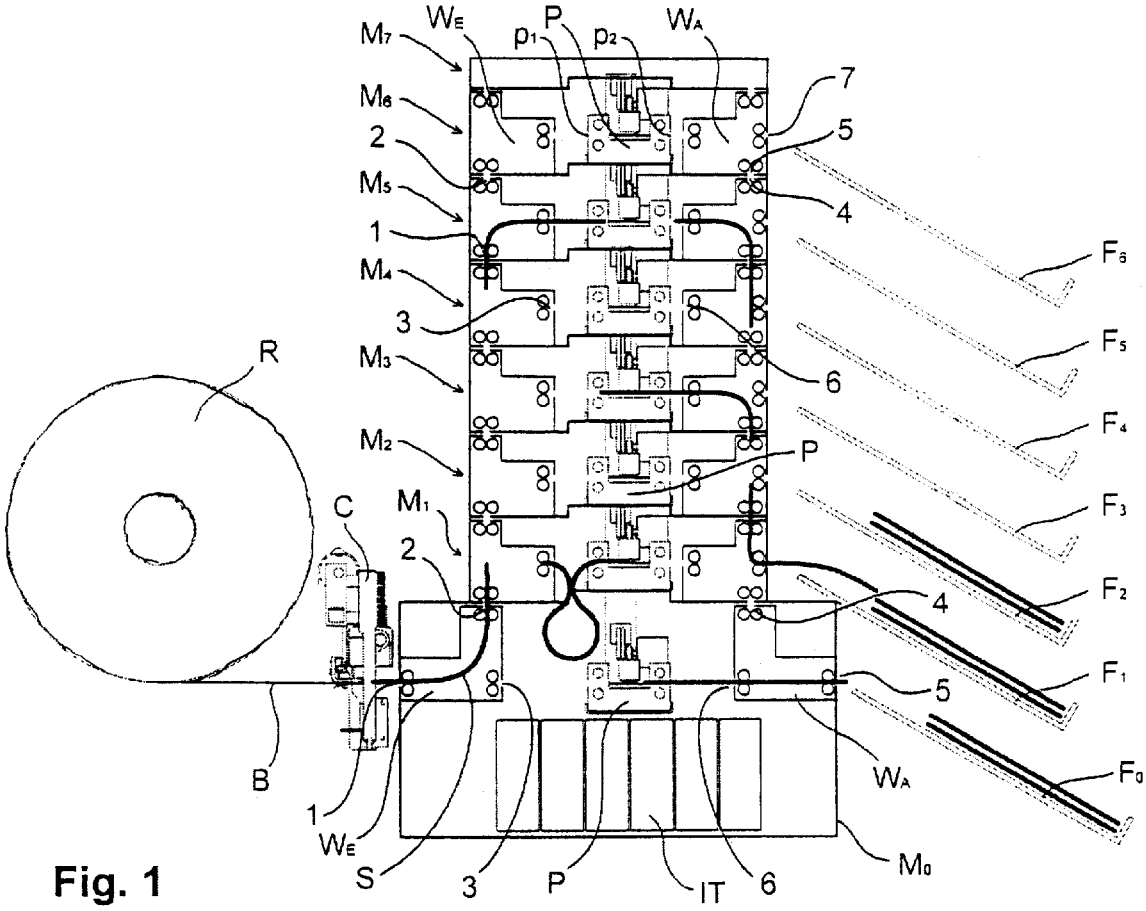
FIG. 1 shows a schematic overall presentation in vertical section of a preferred embodiment of the printing apparatus in accordance with the invention.

As it is apparent from the overall presentation of FIG. 1, the printing apparatus in accordance with the invention as presented in this embodiment includes seven modules, in fact a base module $M_0$ and six expansion modules $M_1$–$M_6$, which are arranged on the base module in a stacked manner one on top of the other. An end element $M_7$ is arranged on the uppermost expansion module $M_6$, which is not essential for the function and serves only as a physical end of the stack of modules.

At the entry side, a cutting unit C is connected in series before the stack of modules composed of the mentioned seven modules $M_0$–$M_6$. The cutting unit C is cutting individual sheets of desired length in a known manner, off a material web B which is held available in form of a roll so that, the material web B is divided into sheet material S. This sheet material S is supplied to the base module $M_0$ where it is printed on or, as will be explained below, further guided to one of the expansion modules $M_1$–$M_6$ for printing there. The cutting of the material web into sheet material S is for example known from the paper supply to photographic printers designed for the processing of sheet material and hence no detailed explanation is needed for the person skilled in the art. For the understanding of the present invention it is merely important, that the base module $M_0$ is supplied with individual sheets to be printed on, i.e. sheet material, and that all modules $M_0$–$M_6$ are designed for the processing of sheet material S.

Also, for greater format flexibility, one or more further rollers having material webs of different widths are preferably arranged adjacent to one another, e.g. in axial direction (perpendicular to the plane of the drawing), and means are provided, in order to cut off a sheet from one or another roll of material web as required and to supply it to the base module. Cutting and transport devices suitable for this are also known from the paper supply to photo graphic printers designed for the processing of sheet material and therefore they are not explained in more detail herein.

An inclined sorting drawer $F_0$–$F_6$ is assigned to each of the seven modules $M_0$–$M_6$ at the exit side, and the sheet material which was printed in the modules is deposited in the sorting drawer, as will be described below.

The six expansion modules $M_1$–$M_6$ are all designed identically. The base module $M_0$ is build in a substantially same manner as the expansion modules and contains furthermore a few additional components, which will be explained in more detail further below.

Each module $M_0$–$M_6$ contains as a central component a complete, conventional printing mechanism P designed for the processing of sheet material, which, for example, is an inkjet printing mechanism. Further, each module contains an input switching unit $W_E$ arranged before the printing mechanism P and an output switching unit $W_A$ arranged after the printing mechanism P as well as a module controller $S_M$ (FIG. 4) not depicted in FIG. 1. The input switching unit $W_E$ supplies the sheet material S to be printed to the printing mechanism P in a corresponding switching position, and the output switching unit $W_A$ removes printed sheet material S from the printing mechanism P in a corresponding switching position. The printing mechanism P and the input and output switching unit $W_A$ or $W_E$ are each provided with transport and drive members (transport rollers and bands driven by a motor) which are known in the art and thus not presented herein. The module controller $S_M$ controls the printing mechanism P in a manner known in the art, and the input and output switching unit $W_A$ or $W_E$ in cooperation with a central control unit $S_Z$ (FIG. 3) not depicted in FIG. 1, which is provided in the base module $M_0$. The image data required for the printing are supplied to the module controller $S_M$ from the central control unit $S_Z$, in a manner which is still to be described.

Each input switching unit $W_E$ has a lower or side input 1 that is in communication with the exterior of the respective module, an upper output 2 that is also in communication with the exterior of the respective module, and an internal output 3 that is assigned to the input p1 of the printing mechanism P of the respective module. Each input switching unit $W_E$ contains two transport paths that lead from input 1 to output 2 or from input 1 to internal output 3 and can be activated alternatively depending on the switching position. The input switching units $W_E$ or their inputs 1 and outputs 2 are arranged in the modules $M_0$–$M_6$ such that each output 2 is aligned with the input 1 of the input switching unit $W_E$ of the module that is arranged immediately above. As is shown in FIG. 1, sheet material S coming from input 1 of the base module $M_0$ can be supplied in this manner to any printing mechanism P of the seven modules $M_0$–$M_6$ through corresponding combinations of switching positions of the input switching units $W_E$ of the individual modules $M_0$–$M_6$. The input switching units $W_E$ of the expansion modules $M_1$–$M_6$ are depicted separately in FIG. 10, and those of the base module $M_0$ are depicted separately in FIG. 11.

Each output switching unit $W_A$ has an upper input 4 that is in communication with the exterior of the respective module, a lower or side output 5 that is also in communication with the exterior of the respective module, an internal input 6 that is assigned to the output p2 of the printing mechanism P of the respective module, and (with exception of the base module $M_0$) an additional side output 7 that is also in communication with the exterior of the respective module. Each output switching unit $W_A$ of the expansion modules $M_1$–$M_6$ contains four transport paths that lead from input 4 to output 5 or from input 4 to additional output 7 or from internal input 6 to output 5 or from internal input 6 to additional output 7. The four transport paths can be activated alternatively depending on the switching position. The output switching unit $W_A$ of the base module $M_0$ contains only two transport paths that lead from input 4 or from internal input 6 to output 5. The output switching units $W_A$ or their inputs 4 and outputs 5 are arranged in the modules $M_0$–$M_6$ such that each input 4 is aligned with the output 5 of the output switching unit $W_A$ of the module that is arranged immediately above. As is shown in FIG. 1, the sheet material S, which is coming from the output p2 of the printing mechanism P of any module, can be supplied in this manner to any sorting drawer $F_0$–$F_6$ through corresponding combinations of switching positions of the output switching unit $W_A$ of the individual modules $M_0$–$M_6$, as long as, the sorting drawer to which the sheet material S is supplied belongs to a module that is not located above the module having the printing mechanism P from which the sheet material S originates. The output switching units $W_A$ of the expansion modules $M_1$–$M_6$ are depicted separately in FIG. 12, and those of the base module $M_0$ are depicted separately in FIG. 13.

In FIG. 1, some sheets of the sheet material S are drawn in different transport phases to illustrate the resulting various transport paths through different combinations of switching positions. A first sheet is just taken over by the cutting unit C and is on its way to module $M_2$. Another sheet is just being supplied to the printing mechanism from the input switching unit in module $M_1$. A further sheet coming from module $M_5$ is guided into the printing mechanism via the input switching unit in module $M_6$. Another sheet just exited the printing mechanism in module $M_5$ and is supplied to module $M_3$ by means of the output switching unit in module $M_4$. A further sheet is still partially within the printing mechanism in module $M_3$ and is guided to module $M_2$ by means of the output switching unit. Another sheet is just leaving module $M_2$ through the additional side output of the output switching unit and slides into a sorting drawer. A last sheet, finally, just leaves the printing mechanism in the base module and is guided into the sorting drawer that is assigned to the base module by means of the output switching unit.

Figure 5:
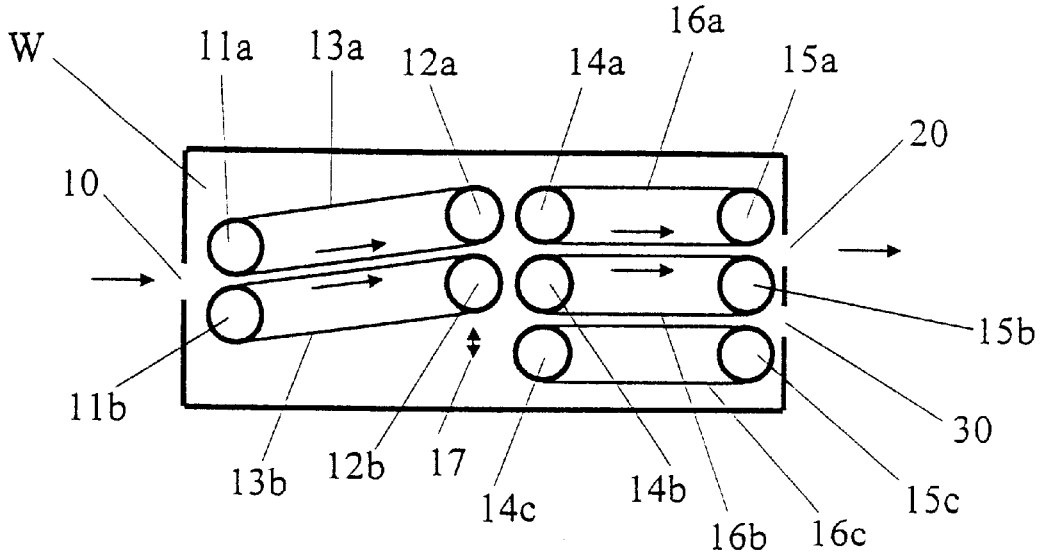
FIGS. 5–6 show two sketches for explaining the input and output switching units of the modules of the apparatus.
Figure 6:
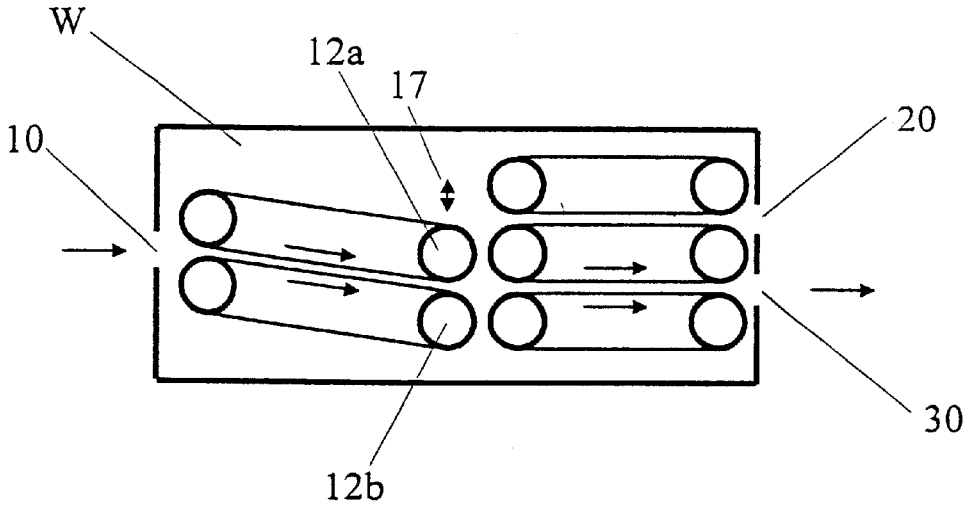

The person skilled in the art is familiar with the practical realisation of the input and output switching units $W_E$ and $W_A$ and can be of any construction which guarantees the described functions. A typical example of how a switching function can be principally realized is presented in FIGS. 5 and 6. The switch W presented therein possesses an input 10 and two outputs 20 and 30. A transport roller pair 11*a*/11*b* is situated at the input 10. A further transport roller pair 12*a*/12*b* is arranged on the inside. A transport belt 13*a* or 13*b* is respectively wrapped about the transport rollers 11*a* and 12*a* as well as the transport rollers 11*b* and 12*b*. Further, three transport rollers 14*a*, 14*b*, and 14*c* as well as three further transport rollers 15*a*, 15*b*, and 15*c* are provided, the latter being located at the outputs 20 and 30 of the switch W. A transport belt 16*a*, 16*b*, 16*c* is respectively wrapped about the transport rollers 14*a* and 15*a*, the transport rollers 14*b* and 15*b*, and the transport rollers 14*c* and 15*c*. The transport roller pair 12*a*/12*b* is movable in the direction of the double arrow into two positions by means of adjusting members not shown in the figures, wherein it is situated in front of the transport roller pair 14*a*/14*b* (FIG. 5) in one position and in front of the transport roller pair 14*b*/14*c* (FIG. 6) in the other position. The transport rollers and hence also the transport belts are driven by drive motors, not shown, and transport sheet material supplied to the switch W at the input 10 through the switch to its output 20 (FIG. 5) or to its output 30 (FIG. 6) depending on the position of the transport roller pair 12*a*/12*b*.

A further important aspect of the invention can be seen in that the modules $M_0$–$M_6$ are designed such that they can be easily arranged in series, i.e. stacked one on top of another, without the requirement for cabling or wiring. The electrical connection of the individual modules with each other is thereby achieved with an electric bus system with corresponding connection and expansion interfaces, e.g. in form of plug-in connections. A common electrical energy supply PS for all modules as well as the already mentioned central control unit $S_Z$ are provided in the base module $M_0$. The central control unit $S_Z$ communicates with the module controllers $S_M$ in the base module $M_0$ and the expansion modules $M_1$–$M_6$ and supplies them with necessary control signals and data and also receives responses therefrom. Of course, the module controller of the base module can also be integrated in the central control unit.

Figure 2:
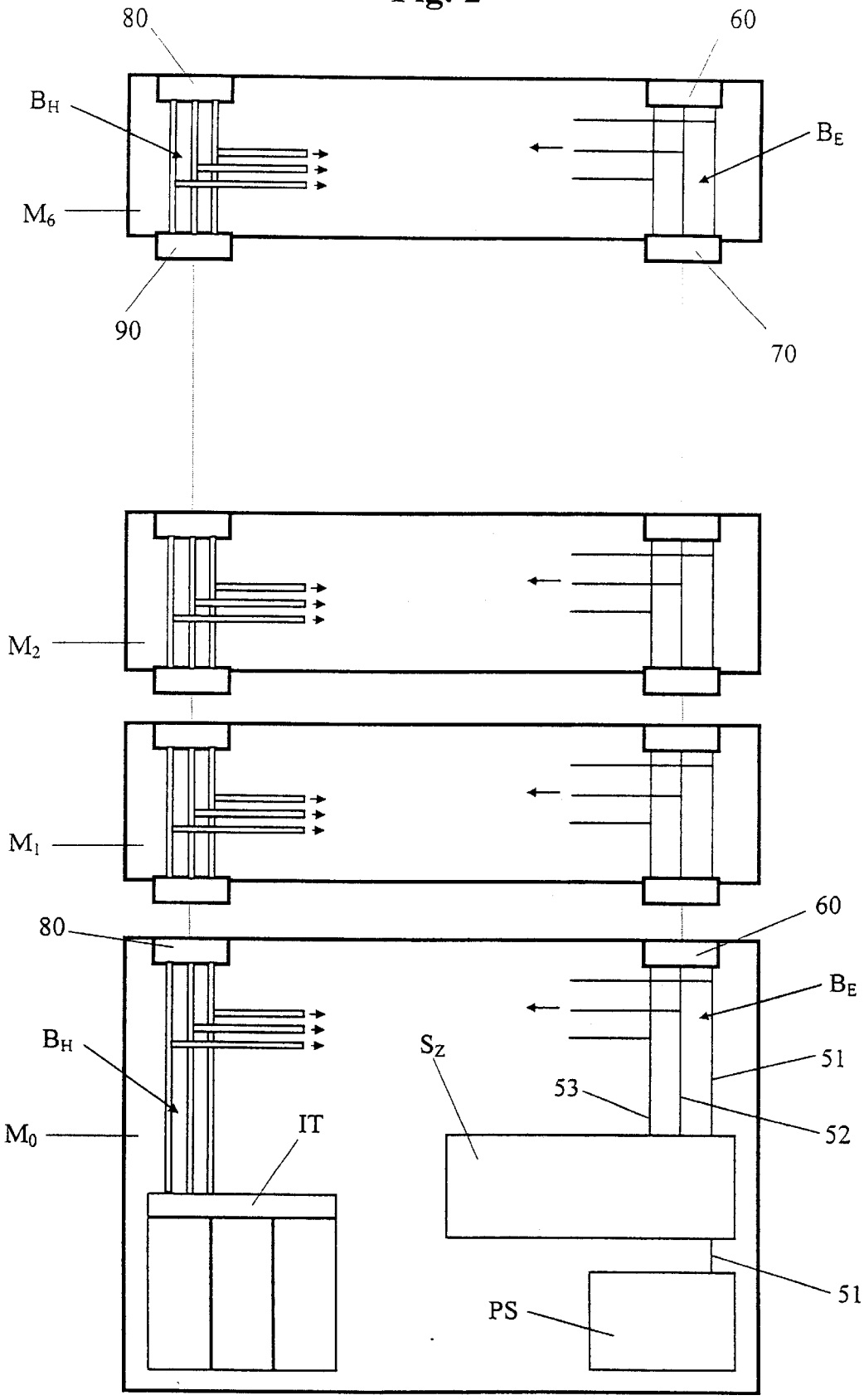
FIG. 2 shows a schematic presentation of the module concept of the invention.

In particular, the electric bus system that is denoted with $B_E$ is presented in FIG. 2. It is composed of three partial bus systems, viz. a power supply bus 51, a data bus 52, and a communications bus 53. Naturally, each of the three partial bus systems includes a greater number of cables/lines, of which only one each is presented for reasons of clarity.

Each module $M_0$–$M_6$ is provided with an electrical expansion interface 60 on its upper side which connects the electrical bus system $B_E$ to the exterior. Each expansion module $M_1$–$M_6$ is additionally provided with an electrical connection interface 70 on its underside which is designed complementary to the electrical expansion interface 60. The electrical bus system $B_E$ is connected through from the electrical connection interface 70 to the electrical expansion interface 60 in each expansion module $M_1$–$M_6$. The electrical expansion interfaces 60 and the electrical connection interfaces 70 are arranged on or in the modules $M_0$–$M_6$ such that the electrical connections are automatically made when the individual modules are stacked one on top of the other.

If the modules are equipped with inkjet printing mechanisms, as in accordance with the presented embodiment, the required ink reservoirs IT (for typically six colours) are situated only in the base module $M_0$ and are common to all modules $M_0$–$M_6$ in accordance with a further important aspect of the invention. The modules are additionally provided with a hydraulic bus system $B_H$, which on one hand connects each module or the printing mechanism P located therein with the ink reservoir IT and, on the other hand facilitates a simple connection of the modules with each other by means of suitable hydraulic connection and expansion interfaces that are provided in each module, for example in the form of plug-in pipe couplings.

In particular, the hydraulic bus system that is denoted with $B_H$ is presented in FIG. 2. It is basically only composed of a number of pipe conduits which corresponds to the number of ink reservoirs IT, of which only three are depicted for reasons of clarity.

Each module $M_0$–$M_6$ is provided with a hydraulic expansion interface 80 on its upper side, which leads the hydraulic bus system $B_H$ to the exterior. Each expansion module $M_1$–$M_6$ is additionally provided with a hydraulic connection interface 90 on its underside, which is designed complementary to the hydraulic expansion interface 80. The hydraulic bus system $B_H$ is connected through from the hydraulic connection interface 90 to the hydraulic expansion interface 80 in each expansion module $M_1$–$M_6$. The hydraulic expansion interfaces 80 and the hydraulic connection interfaces 90 are arranged on or in the modules $M_0$–$M_6$ such that the hydraulic connections are automatically made when the individual modules are stacked one on top of the other.

It is understood, that corresponding ink pumps are provided for supplying the inkjet printing mechanisms P. The ink pumps convey the different printing inks from the reservoirs IT to the printing mechanisms P. However, suitable pumps are known in the art and hence are not presented for reasons of clarity.

Figure 7:
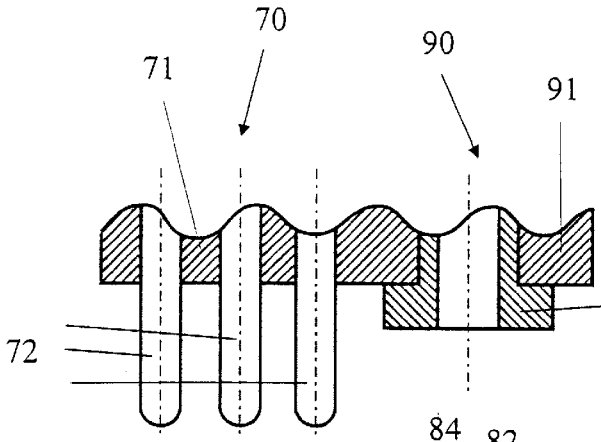
FIGS. 7–9 show three sketches for explaining the set-up of the electrical and hydraulic connection and expansion interfaces of the modules of the printing apparatus.
Figure 8:
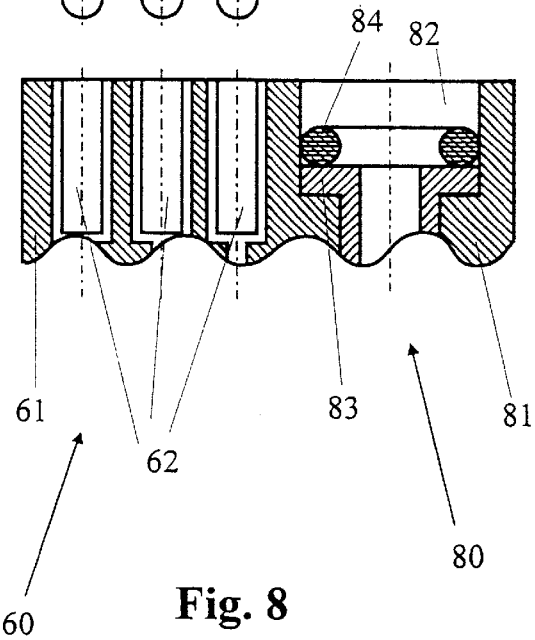
Figure 9:
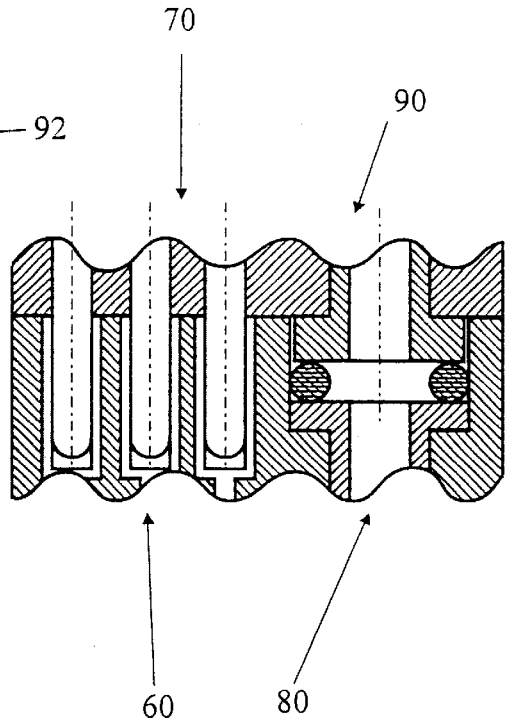

FIGS. 7–9 show sectional views of exemplary embodiments of the electrical and hydraulic connection and expansion interfaces 60–90 of the electrical and the hydraulic bus system $B_E$ and $B_H$, respectively.

The electrical expansion interface 60 and the electrical connection interface 70 are designed as a complementary plug-in system. The connection interface 70 includes a socket 71 in which a number of electrical contact prongs 72 are held. The expansion interface 60 includes a corresponding socket 61 in which a number of contact plugs 62 are held. For reasons of clarity only three contact prongs 72 and contact plugs 62, respectively, are presented. The contact prongs 72 and the contact plugs 62 are connected with electrical lines of the electrical bus system.

The hydraulic expansion interface 80 and the hydraulic connection interface 90 are designed as a complementary plug-in pipe coupling system. The connection interface 90 includes a socket 91 holding a number of pipe end connectors 92 therein, of which only one is depicted. The pipe end connectors 92 are each connected with a pipe conduit of the hydraulic bus system $B_H$ and form themselves the ends of these conduits. The expansion interface 80 includes a socket 81 in which a number of cylindrical bores 82 are arranged, wherein only one such bore is depicted for reasons of clarity. The end of a pipe conduit of the hydraulic bus system $B_H$ is held in each bore 82, wherein the end of the pipe conduit is provided with a flange 83. Furthermore, a sealing ring 84 is provided in each bore 82.

The sockets 71 and 91 of the electrical and hydraulic connection interfaces 70 and 90 are physically combined into a common socket. Accordingly, sockets 61 and 81 of the electrical and hydraulic expansion interfaces 60 and 80 are physically combined into a common socket.

FIG. 9 shows the electrical and hydraulic connection and expansion interfaces in a plugged-in condition, which results when two modules are stacked one on top of the other.

Figure 3:
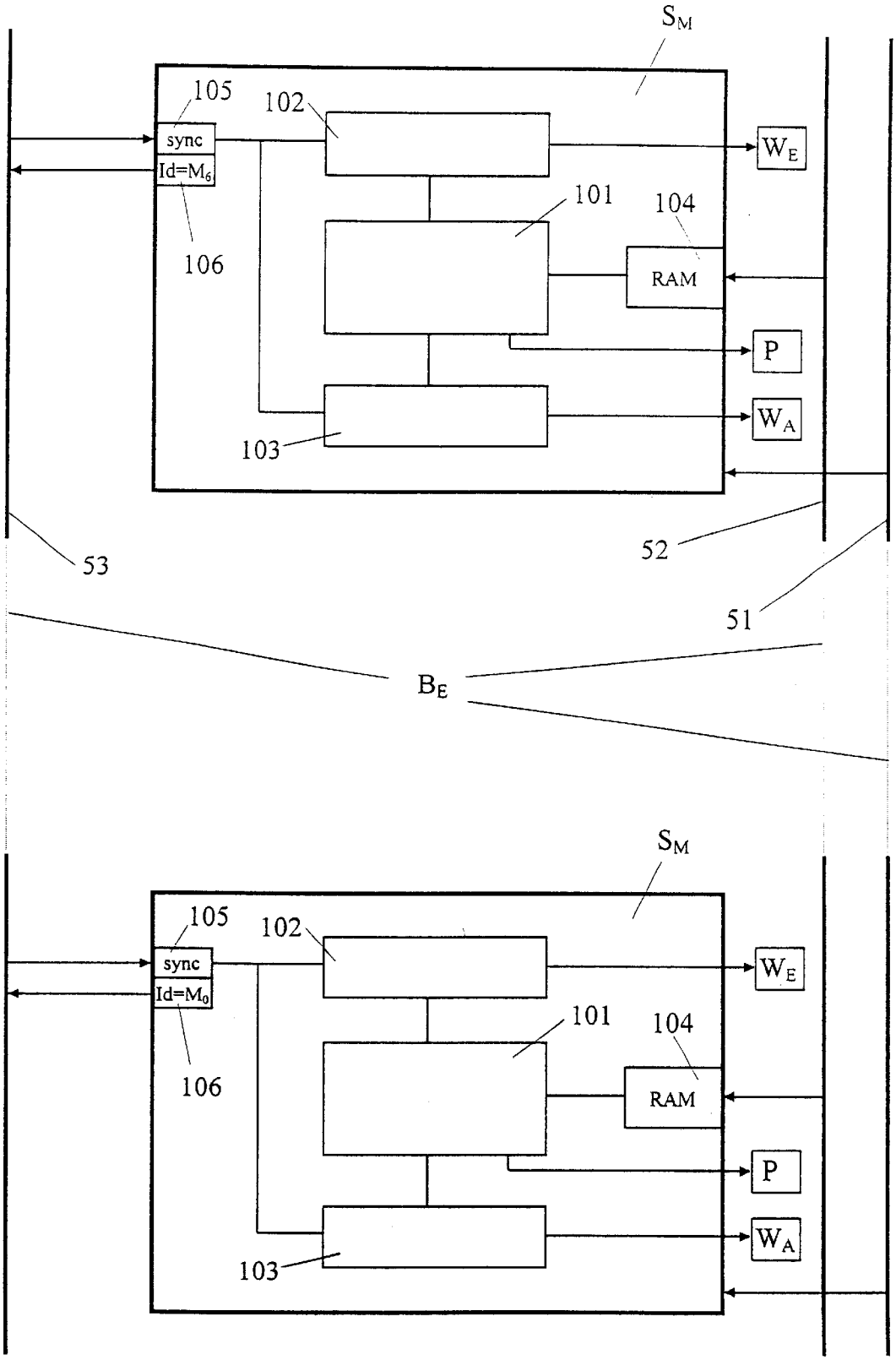
FIGS. 3–4 show a schematic block presentation of the most important control units or control functions of the apparatus.
Figure 4:
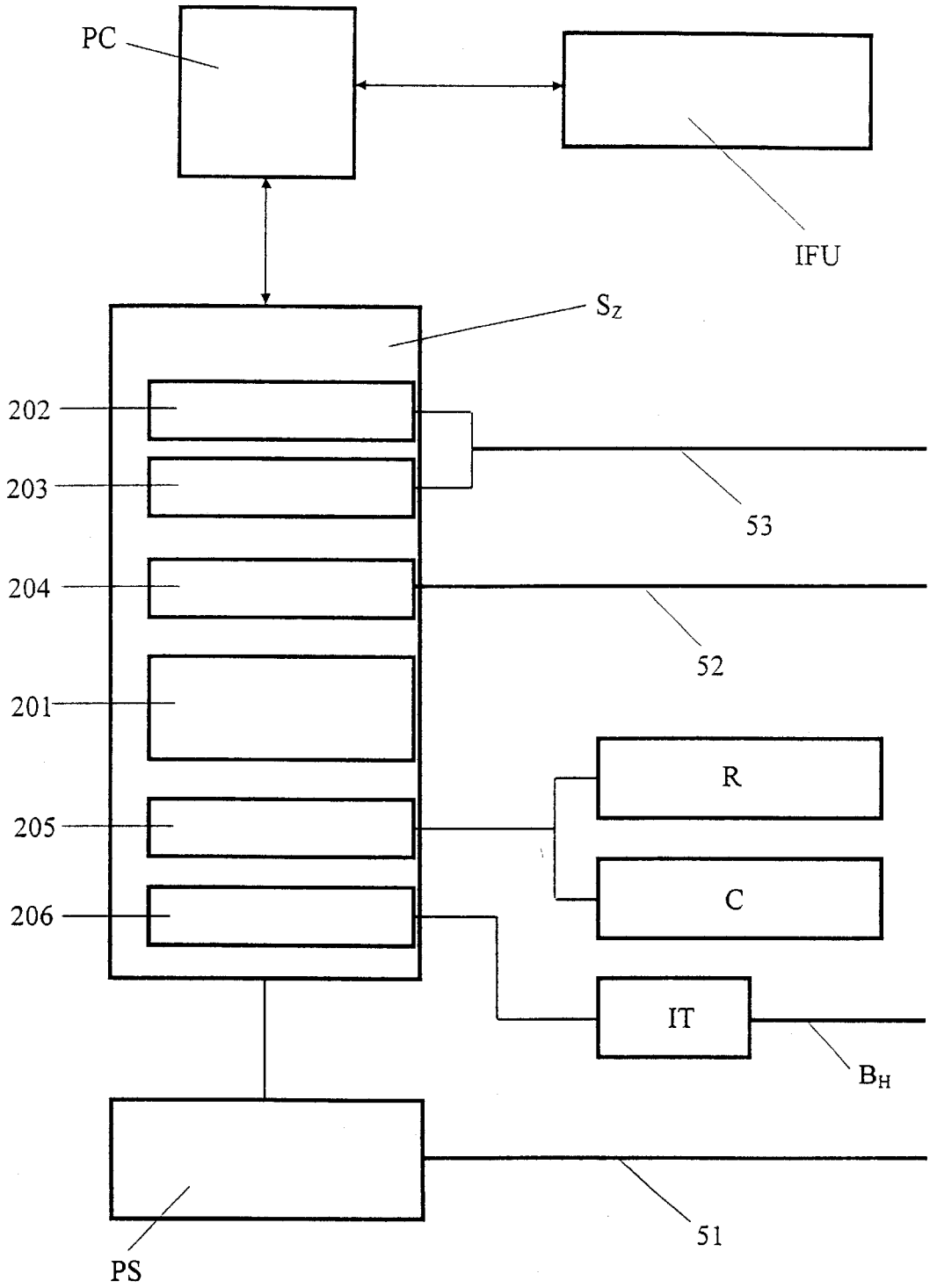

FIGS. 3 and 4 show schematically the principal design of the module controllers $S_M$ available in the individual modules $M_0$–$M_6$ as well as the central control unit $S_Z$ provided in the base module $M_0$.

Each module controller $S_M$ basically includes a printing mechanism controller 101, an input switch controller 102 activating the input switching unit $W_E$, an output switch controller 103 activating the output switching unit $W_A$, an image data memory 104, a synchronization controller 105, and an identification module 106. Through the latter, the central control unit $S_Z$ in the base module $M_0$ determines and identifies the presence of an expansion module $M_1$–$M_6$ through the communication bus 53 of the electrical bus system $B_E$. The synchronization controller 105 cooperates with the central control unit $S_Z$ through the communication bus 53 and, under control of the central control unit $S_Z$, operates the input and output switch controllers 102 or 103, such that the sheet material follows the transport path that is assigned by the central control unit $S_Z$. The image data storage 104 receives the image data representing the images to be printed from the central control unit $S_Z$ through the data bus 52. Finally, the printing mechanism controller 101 controls the printing mechanism P in a manner known in the art. The power supply of the module controller $S_M$ and of all the components controlled thereby, is carried out through power supply bus 51.

The central control unit $S_Z$ in the base module $M_0$ is constructed, in a manner known in the art, as a digital computer, which is supplied with energy through the power supply unit PS and is connected to the data bus 52 and the communication bus 53. The central control unit $S_Z$ is further connected to an external operating unit PC, e.g. in form of a personal computer, which in turn cooperates with an interface unit IFU, or contains the interface unit IFU. Of course, the latter can be directly integrated with the central control unit $S_Z$.

The central control unit $S_Z$ contains basically six functional units implemented as software, which are a system monitoring unit 201, a synchronization unit 202, a module identification unit 203, an image data unit 204, a paper control unit 205, and an ink control unit 206.

The ink control unit 206 controls the supply of the required printing inks to the individual modules $M_0$–$M_6$ from the ink reservoirs IT through the hydraulic bus system $B_H$.

The paper control unit 205 controls the drive for the paper roll R and the cutting unit C. If required, it also allows the selection of different material web widths from different rolls R and then also controls the supply of sheet material S into the base module $M_0$.

The module identification unit 203 recognizes and identifies the existing expansion modules $M_1$–$M_6$ through the communications bus 53.

The synchronization unit 202 manages the capacity utilization of the base module $M_0$ and the possibly present expansion modules, in that it distributes the printing jobs to be performed to the modules for performance optimization, and guides the sheet material through the apparatus by accordingly selecting the input and output switching units in the modules. In addition, a sorting of the printed sheet material can be carried out.

The image data unit 204 guides the image data supplied from the operating unit PC or the interface unit IFU to the individual modules via the data bus 52.

The system monitoring unit 201 monitors, in a manner known in the art, the function of the remaining components and functional units.

The interface unit IFU serves basically for data entry and data output and for the communication of the apparatus or the entire system with other computers. It includes, aside from common communication interfaces in computers, a network interface, a modem, one or more reader devices for data carriers, a connection for a scanner or a scanner itself, a connection for a digital camera etc. In particular, the image data for the printing jobs to be carried out are supplied to the apparatus through the interface unit IFU.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An apparatus for printing on sheet material, comprising:

a number of modules capable of being aligned physically adjacent to one another, each module including a printing mechanism;

a modular distribution means distributed amongst the modules, for distributing sheet material to be printed to the available modules and for collecting and sorting printed sheet material as required, wherein said modules are shaped and constructed to be stackable one on top of the other; and an expandable electrical bus system for providing a power supply to the modules and for connecting the modules, such that electrical connection is automatically made between modules when the individual modules are stacked one on top of the other, wherein said electrical bus system includes a power supply bus, a data bus, and a communication bus.

2. Apparatus as defined in claim 1, wherein the modules include an electrical module controller, each module including an input switching unit having an input and an output and positioned in series before the printing mechanism and output transport means for removing printed sheet material from the printing mechanism, whereby the input switching units and the output transport means of the modules together form the distribution means, and wherein said input switching unit in each module is designed for supplying sheet material to be printed, and supplied through the input, selectively to at least one of the printing mechanism of the module and through the output to an input switching unit of an adjacent module.

3. Apparatus as defined in claim 2, wherein the output transport means of each module is constructed as an output switching unit having an input and an output, said output switching unit selectively taking up printed sheet material either from at least one of the printing mechanism of the associated module and from the output of an immediately adjacent module via the input of said output switching unit and for supplying the printed sheet material to the output of the output switching unit.

4. Apparatus as defined in claim 3, wherein an output switching unit of at least one of the modules includes an additional output, and wherein the output switching unit is designed for selectively supplying printed sheet material to one of the output of said output switching unit and to the additional output of said output switching unit.

5. Apparatus as defined in claim 2, wherein the input switching units are arranged in the modules and designed such that the output of the input switching unit of one module is aligned with the input of an input switching unit of an immediately adjacent module.

6. Apparatus as defined in claim 3, wherein the output switching units are arranged in the modules and designed such that the input of the output switching unit of one module is aligned with an output of an output switching unit of an immediately adjacent module.

7. Apparatus as defined in claim 1, including a base module and at least one expansion module, said base module including an electrical interface for the electrical bus system, said expansion module including an electrical expansion interface and a complementary electrical connection interface for the electrical bus system, said electrical connection interface being complementary to the electrical expansion interface, said electrical bus system being connected through from the electrical connection interface to the electrical expansion interface in the at least one expansion module.

8. Apparatus as defined in claim 7, wherein the electrical expansion interface and the electrical connection interface of the electrical bus system are in such a way arranged in the modules and designed that when an expansion module is physically added to the base module or to an existing expansion module, an electrical connection is automatically made between an electrical connection interface of the added expansion module and an electrical expansion interface of the base module or the existing expansion module.

9. Apparatus as defined in claim 7, wherein the base module includes a common electric power supply for all modules, said power supply being connected with the electrical bus system, and wherein the base module includes a central control unit, said central control unit being connected with the electrical bus system, and wherein said central control unit is connected with the electrical module controller in the expansion modules via the electrical bus system.

10. Apparatus as defined in claim 1, including a base module and at least one expansion module, wherein the printing mechanisms in the modules are inkjet printing mechanisms, wherein the base module includes a common ink reservoir for the inkjet printing mechanisms of all modules, and wherein an expandable hydraulic bus is provided, said expandable hydraulic bus system being connected with the ink reservoir for supplying the inkjet printing mechanisms in the individual modules.

11. Apparatus as defined in claim 10, wherein the base module includes a hydraulic expansion interface for the hydraulic bus system, wherein each expansion module includes a hydraulic expansion interface and a complementary hydraulic connection interface for the hydraulic bus system, said hydraulic connection interface being complementary to said hydraulic expansion interface, and wherein the hydraulic bus system is connected through in each expansion module from the hydraulic connection interface of the hydraulic bus system to the hydraulic expansion interface of the hydraulic bus system.

12. Apparatus as defined in claim 11, wherein the hydraulic expansion interfaces and the hydraulic connection interfaces of the hydraulic bus system are in such a way arranged in the modules and designed that when an expansion module is physically added to the base module or to an existing expansion module, a hydraulic connection is automatically made between the hydraulic connection interface of the added expansion modules and at least one of the hydraulic expansion interface of the base module and the existing expansion module.

* * * * *